US006849342B1

(12) United States Patent
Stenzel et al.

(10) Patent No.: US 6,849,342 B1
(45) Date of Patent: Feb. 1, 2005

(54) METAL-CERAMIC COMPOSITE MATERIAL BODY AND METHOD FOR PRODUCING THE SAME

(75) Inventors: Otto W. Stenzel, Wüstenrot-Neuhütten (DE); Klaus Czerwinski, Iggingen (DE); Iris Postler, Leonberg (DE); Bernd Reinsch, Ludwigsburg (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/130,092

(22) PCT Filed: Nov. 6, 2000

(86) PCT No.: PCT/EP00/10930

§ 371 (c)(1),
(2), (4) Date: Aug. 27, 2002

(87) PCT Pub. No.: WO01/34865

PCT Pub. Date: May 17, 2001

(30) Foreign Application Priority Data

Nov. 11, 1999 (DE) ..... 199 54 205

(51) Int. Cl.[7] ..... B32B 15/04

(52) U.S. Cl. ..... 428/469; 428/610; 428/627; 428/472.2; 428/698; 428/701; 428/702

(58) Field of Search ..... 408/610, 627, 408/632, 629, 469, 620, 621, 633, 650, 472, 472.2, 698, 701, 702, 697, 699

(56) References Cited

U.S. PATENT DOCUMENTS 6,037,066 A * 3/2000 Kuwabara ..... 428/610

FOREIGN PATENT DOCUMENTS

| | | |
|---|---|---|
| DE | 197 50 599 | 7/1998 |
| EP | 0 622 476 | 11/1994 |
| EP | 0 679 725 | 11/1995 |

OTHER PUBLICATIONS

Samotugin S. et al., "Surface Treatment of Sintered Hard Alloys with a Highly Concentrated Plasma Jet," Welding International, B, Welding Institute, Abington, vol. 8, No. 10, 1994, pp. 816–818.

* cited by examiner

*Primary Examiner*—Jennifer McNeil
(74) *Attorney, Agent, or Firm*—Kenyon & Kenyon

(57) ABSTRACT

The present invention relates to a method of fabrication and a product, which forms a composite body made of metal and a porous ceramic blank, which adjoins the metallic portion and is infiltrated by the metal, wherein a gradient in properties across the composite portion of the composite body is formed by a heat treatment that reduces some of the oxides across the thickness of the porous ceramic blank. In one embodiment, a gradient from substantial chemical reaction to incomplete chemical reaction of the reducible oxides of the blank with the infiltrated metal is formed inside the composite portion.

10 Claims, 1 Drawing Sheet

METAL-CERAMIC COMPOSITE MATERIAL BODY AND METHOD FOR PRODUCING THE SAME

FIELD OF THE INVENTION

The present invention relates to a composite body made of a metal and a porous ceramic blank, which is adjoined to the metal and is infiltrated by a portion of the metal, wherein the oxides of the blank, which are reducible by the metal, have reacted at least partially with the infiltrated metal to form intermetallic phases and metallic oxides.

BACKGROUND OF THE INVENTION

The infiltration of the porous ceramic blanks, also referred to as pre-molded bodies, by a metal alloy to produce members or surfaces having higher loading capacities is known. Porous ceramic blanks can include, but are not limited to, passive ceramics, such as aluminum oxide ($Al_2O_3$), SiC, or AIN, and reducible metallic oxides (for example, oxides of Fe, Lr, Lo, Mu, Mo, Ti, Ni, Nb, Cu, Zr, V, W, and Ta). These are infiltrated by a light-metal alloy, in particular an aluminum alloy, for example, in a die-casting process. It is also known that, during the infiltration process, for example during a die casting process that lasts less than 1 second, the chemical reaction is negligible between the metal and the metallic oxides of the porous ceramic. Therefore, the composite body to be manufactured is typically subjected to a heat treatment at very high temperature after the infiltration process has been completed. Carrying out such a heat treatment, which should preferably be done at a temperature considerably greater than the solidus temperature of the metallic component, only makes sense in members wherein the porous ceramic blank is 100% coincident with the volume of the metallic portion of the composite body. There can be no portion of the pure metal, if a heat treatment is to be completed, because the metal portion would melt or at least would deform at temperatures sufficient to heat treat the composite body.

German Patent Document No. 197 50 599 A1, for example, proposes casting a series of layers of differently constructed, porous ceramic blanks with a recast made of a pure metal alloy. In this case, the blanks are layered in such a manner that the infiltrated blank, which forms the composite-body surface subjected to loading and wear, is mainly constituted of intermetallic phases, specifically aluminides, in the pores of the blank. In addition, unreacted metal alloy, i.e. a mixture of intermetallic phases and metal alloy, is situated in the layers facing away from the surface layer, the metallic oxides previously contained in the blank having been completely converted to intermetallic phases. After the infiltration, the examples of this publication provide for either a thermal post-treatment (annealing) being carried out to completely reduce the metallic oxide present in the specific blank (examples 1–4), or an individual, uniformly constructed blank being filled with metal alloy in a die-casting mold, during an infiltration time period of approximately 1/10 sec. This achieves, at best, an incomplete chemical reaction of the metallic oxide with the metal of the recast.

SUMMARY OF THE INVENTION

The present invention is directed to a composite body having a metal portion adjoined to a composite portion, wherein the composite portion is a metal infiltrated ceramic blank wherein an effective bond capable of bearing high loads is created between the infiltrated ceramic blank and the metal portion.

One object of the invention is that a substantial reaction occurs between the reducible oxides of the porous ceramic blank and the infiltrated metal, which can only be achieved at high temperatures over appropriately long periods of time. Another object of the invention is that the reaction takes place in regions whose load-bearing capacity should be increased.

In one embodiment of the present invention, a continuous gradient in the degree of oxide-metal reaction occurs in the direction from the interface of the metallic portion and the composite portion that progresses from advanced chemical reaction to incomplete chemical reaction of the reducible oxides of the blank.

In one typical embodiment of the present invention, a larger proportion of the reducible oxides are reduced by the infiltrated metal at the free surface of the composite portion of the composite body than near the interface between the metal portion and the composite portion of the composite body.

The compositional gradients that are present in the composite body, as a result of the gradient in the degree of reaction should be understood to be continuous, which means that discontinuities or abrupt steps are avoided, and a curve of the level of chemical conversion versus distance from the free surface of the compositional portion to the interface between the compositional portion and the metal portion would exhibit continuity.

In a typical embodiment of the invention, the formation of intermetallic phases during the reactional infiltration of the porous ceramic blank leads to an increase in hardness and, in general, a higher load-bearing capacity of the composite-body. It is desirable to have the portion with the highest degree of reaction as the region mostly subjected to wear, and as one object of the invention, it is intended that the reducible metallic oxides near the surface are substantially converted. For example, the portion of the infiltrated porous ceramic blank near the metallic portion of the composite body has a larger proportion of unreacted metal in the pores of the porous ceramic blank than would be found at a location closer to the free surface of the composite portion. This results in the porous ceramic blank being more effectively bonded to the metallic portion, without having to use various layers of different blank materials and compounds.

In a specific embodiment, the region reacting in an incomplete manner extends from the metal interface to approximately 1/8 to 7/8 of the thickness of the composite body, in the direction away from the interface.

In an embodiment wherein the blank is made of aluminum oxide ($Al_2O_3$) and reducible metallic oxides prior to the production of the composite body, then these reducible metallic oxides are reduced by the reliquified (and previously infiltrated) aluminum alloy during the heat treatment. In other words, the oxygen of the metallic oxides combines with the aluminum to form aluminum oxide, and the reduced metal of the metallic oxides combines with the aluminum alloy to form intermetallic phases in the form of aluminides.

An embodiment of the present invention produces a composite body having a thermal expansion coefficient gradient of less than $12 \cdot 10^{-6}$/K to greater than $15 \cdot 10^{-6}$/K across the thickness of the infiltrated ceramic blank, in the direction of the metallic portion of the composite body. The coefficient of thermal expansion is between 6 and $12 \cdot 10^{-6}$/K in the loaded surface region, and between 10 and $20 \cdot 10^{-6}$/K, or 12 to $20 \cdot 10^{-6}$/K in the transition region leading to the metallic portion of the composite body. This achieves a thermal expansion coefficient that substantially approximates the thermal expansion coefficient of the metallic portion, which means that the bond to the metallic portion of the composite body is improved by the present invention.

The object of the present invention is also to provide a method for manufacturing a composite body of the type mentioned at the outset, a thermal treatment of the infiltrated blank being carried out after the blank is infiltrated. The method of the present invention is characterized in that intensive, local heat input allows the regions of the infiltrated blank to be brought to temperatures greater than 500° C., in particular greater than 650° C. or greater than 700° C., and to be maintained for a short time; and in that the cooling of the metallic portion of the composite body allows its temperature to be kept under the solidus temperature of the metal. Therefore, the present invention provides for the temperature necessary for the reducible metallic oxides to substantially react with the infiltrated metal being made available where this is desired. On the other hand, intensive cooling of the metallic portion of the composite body ensures that the temperature there does not exceed the heat-treatment temperature permissible for the specific metal alloy, so that the rigidity and the grain structure of the metallic portion of the composite body are not impaired.

The local heating may be carried out, for example, in an inductive manner and/or using laser energy or a lamp (halogen lamp or arc lamp) focused on the surface, or using a plasma arc. Heating powers greater than 250 W/cm$^2$, preferably greater than 1000 W/cm$^2$, and in particular greater than 2000 W/cm$^2$, are used to locally heat regions near the surface of the infiltrated part of the composite body in a highly intense manner. Depending on the reaction potential of the composite and the dissipation of heat through the member, the further chemical conversion may automatically proceed in the direction parallel to the surface, and downwards. In the case of automatic progression, it may be sufficient to input the high power density required for ignition at only one position. When the reactivity is not sufficient and too much heat is being dissipated by the rest of the member, the reaction is supported by the first heat source or another heat source, so that the desired, spatial expansion of the conversion zone and the degree of conversion are set. The consequently obtained temperature gradient inside the infiltrated portion of the composite body creates a continuous curve between completely/mostly reacted regions and unreacted/incompletely reacted regions.

The metallic portion of the composite body is cooled, using liquid coolants such as water, oil, or other liquids. The use of gases is less preferable, since the resistances to heat transfer are too large.

BRIEF DESCRIPTION OF THE FIGURES

For the purpose of illustrating the invention, representative embodiments are shown in the accompanying figures, it being understood that the invention is not intended to be limited to the precise arrangements and instrumentalities shown.

DETAILED DESCRIPTION OF THE PREFERRED EMBODIMENTS

The present invention will now be described in detail for specific preferred embodiments of the invention. These embodiments are intended only as illustrative examples and the invention is not to be limited thereto.

Figure 1:
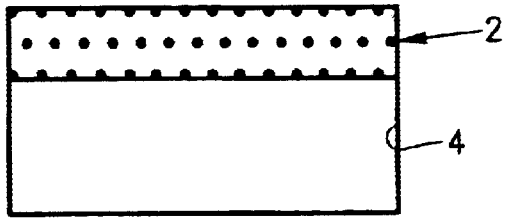
FIG. 1 illustrates one embodiment of a porous ceramic blank in a casting mold.
Figure 2:
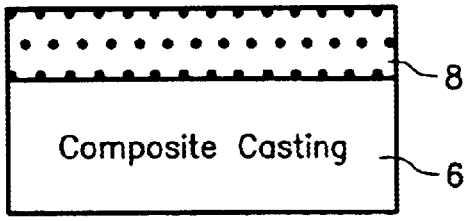
FIG. 2 shows a schematic representation of one embodiment of the composite body.
Figure 3:
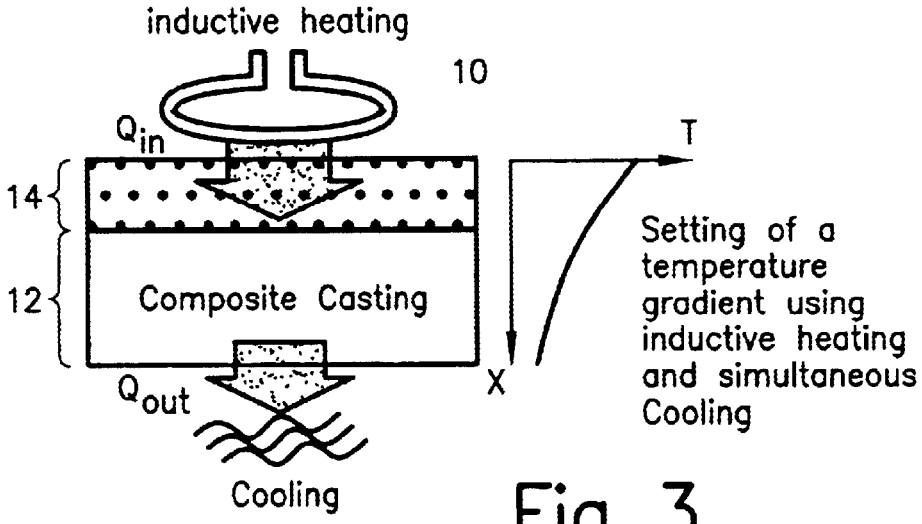
FIG. 3 illustrates one embodiment of the method of production, showing the localized heating and cooling of the composite body and the resulting temperature profile within the composite body.

In one specific embodiment, as illustrated by FIG. 1, a ceramic blank 2 comprises metallic oxides having a porous structure, for example porous aluminum oxide ($Al_2O_3$). The porous ceramic blank is placed in a casting mold 4. When the casting mold is filled with technical-grade aluminum die-casting alloy 6 and the porous ceramic body is thereby infiltrated, then this results in the conversion of the blank, albeit to a small extent, to a composite body made of $Al_2O_3$ and intermetallic compounds, for the infiltrated metal in the form of the aluminum die-cast alloy reduces the reducible metallic oxides to form intermetallic phases and additional aluminum oxide.

In specific embodiments, the local properties of the as-cast component body can differ from those of the aluminum alloy. For example the tribological, mechanical, physical, or chemical properties of the component body may be adjusted by the chemical conversion. In an alternative embodiment, wherein the porous ceramic blank is unreactive or only slightly reactive with the selected metal alloy, the chemical conversion during the infiltration procedure does not proceed or is negligible. Then, a thermal post-treatment at temperatures greater than 500° C. is necessary to complete the chemical reactions.

However, temperatures greater than 450° C. exceed permissible heat-treatment temperature for die-cast or pressure-cast aluminum parts. If ceramic castings, in which the ceramic blank only takes up a small portion of the volume, are heated to temperatures above 450°, then the gases dissolved in the aluminum metallic portion are liberated to form bubbles. In addition, the rigidity of the composite body is impaired, when it is heated above the solidus point of the aluminum alloy. Therefore, such heat treatment is limited to a composite body, in which the ceramic blank takes up almost all of the volume of the ceramic member.

In order to initiate the conversion reaction, one specific embodiment of the present invention uses a very high heating-power density locally for a limited period of time, for example in the range of a few seconds, in the regions in which the specific properties should be substantially changed, for example strengthened or hardened. In a preferred embodiment, the heating is inductive heating. For example, the penetration depth of the induced, alternating field and, therefore, the heating of the composite body may be controlled or adjusted by suitably dimensioning induction coil 10 and adjusting the frequency of the alternating current. To prevent overheating in the metallic portion 12 of the composite body, for example to avoid bubble formation and melting, the metallic portion 12 of the composite body is intensively cooled, for example by water, oil, or other liquid coolants. In one possible embodiment, the metallic portion of the component body is cooled by forced-gas cooling. When the heating (amount of heat input $Q_{in}$) and cooling (amount of heat dissipated $Q_{out}$) are selectively controlled, a stationary temperature gradient T(x) is formed in the part, which results in a continuous curve of the level of chemical conversion in infiltrated region 14, wherein the composition gradient of the composite portion is a continuous curve that is proportional to the extent of the conversion, for example the converted regions having ceramic and intermetallic compounds and the regions converted to a lesser extent having ceramic, reducible oxide components, and infiltrated metal).

For example, in one specific embodiment of the invention, the heat treated, completely converted, and infiltrated composite portion 18 of the composite body is distinguished by improved properties, such as tribological, mechanical, and thermal properties; chemical loading capacity, and/or a thermal expansion coefficient which is adapted to that of the metallic portion. Within the portion of the infiltrated composite portion that is heat treated, but remains unconverted 20, the properties remain unaltered by the heat treatment and are characterized, for example, by a high thermal conductivity and a coefficient of thermal expansion compatible with the metallic portion. Such a continuous transition of the thermal expansion behavior from a thermal expansion coefficient around $10 \cdot 10^{-6}$/K in the substantially converted portion of the composite body, to values around $15 \cdot 10^{-6}$/K in the slightly converted or unconverted region can determine the service life of cyclically, thermally, and highly loaded composite castings, because the thermal stresses at the interface between the composite portion and the metallic portion are reduced for a metallic portion having a thermal expansion coefficient of $20–25 \cdot 10^{-6}$/K, for example).

Figure 4:
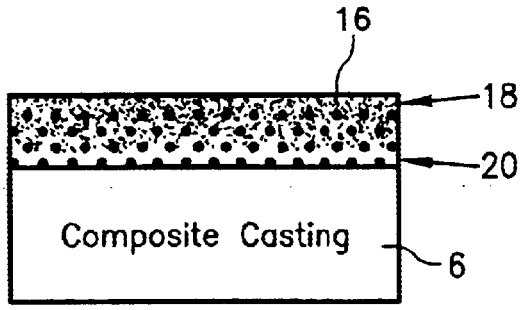
FIG. 4 illustrates the compositional gradient in the treated composite body.

The illustration in FIG. 4, shows one specific embodiment of the invention having a continuous gradient in the extent of the reduction reaction, ranging from substantial in a region 18 near the free surface 16 of the composite portion to a negligible reaction in a region 20 near the interface between the composite portion and the metallic portion of the composite body, wherein the fraction of intermetallic and the hardness, for example, are a function of the extent of the reduction reaction.

What is claimed is:

1. A composite body comprising:

a metallic portion; and a composite portion, wherein the composite portion adjoins the metallic portion at an adjoining interface, and wherein the composite portion has a free surface opposite of the adjoining interface, and wherein the composite portion comprises:

a porous ceramic blank; and a segment of the metallic portion which infiltrates the porous ceramic blank;

wherein the porous ceramic blank comprises reducible oxides, and wherein the reducible oxides of the blank at least partially react with the infiltrated metallic portion to form intermetallic phases by a chemical reaction, and wherein the composite portion has a gradient, from the free surface to the adjoining interface, in a volume fraction of intermetallic phases.

2. The composite body as recited in claim 1, wherein the volume fraction of the intermetallic phases within the composite portion immediately adjacent to the adjoining interface is negligible.

3. The composite body as recited in claim 2, wherein the volume fraction of the intermetallic phases is negligible from the adjoining interface to a distance from the adjoining interface within a range of distance selected to be about ⅛ to ⅞ of the thickness of the composite portion.

4. The composite body as recited in claim 1, wherein the metallic portion is an aluminum alloy.

5. The composite body as recited in claim 4, wherein the aluminum alloy is a die-cast aluminum alloy.

6. The composite body as recited in claim 1, wherein the porous ceramic blank comprises a material selected from the group consisting of aluminum-oxide, silicon-carbide, aluminum-nitride, and combinations thereof.

7. The composite body as recited in claim 1, wherein the composite portion has a gradient in a thermal expansion coefficient ranging from less than $12 \cdot 10^{-6}$/K to greater than $15 \cdot 10^{-6}$/K in the direction of the adjoining interface.

8. The composite body as recited in claim 7, wherein the thermal expansion coefficient in an area near the free surface is selected to be within a range between $6 \cdot 10^{-6}$/K and $12 \cdot 10^{-6}$/K.

9. The composite body as recited in claim 7, wherein the thermal expansion coefficient in an area near the adjoining interface is selected to be within a range between $10 \cdot 10^{-6}$/K and $20 \cdot 10^{-6}$/K.

10. The composite body as recited in claim 7, wherein difference between the thermal expansion coefficient of the metallic portion adjacent to the adjoining interface and the thermal expansion coefficient of the composite portion adjacent to the adjoining interface is less than $5 \cdot 10^{-6}$/K.

* * * * *

UNITED STATES PATENT AND TRADEMARK OFFICE

CERTIFICATE OF CORRECTION

PATENT NO. : 6,849,342 B1
DATED : February 1, 2005
INVENTOR(S) : Otto W. Stenzel et al.

It is certified that error appears in the above-identified patent and that said Letters Patent is hereby corrected as shown below:

Column 1,
Line 19, change "AIN" to -- AlN --.

Signed and Sealed this

Thirteenth Day of December, 2005

JON W. DUDAS
*Director of the United States Patent and Trademark Office*